United States Patent [19]

Walther et al.

[11] 4,136,403

[45] Jan. 30, 1979

[54] HEAD GUARD ASSEMBLY COMPRISING A PROTECTIVE HELMET AND A PROTECTIVE BREATHING MASK

[75] Inventors: Hans J. Walther; Manfred Gdulla, both of Lübeck, Germany

[73] Assignee: Drägerwerk Aktiengesellschaft, Germany

[21] Appl. No.: 831,133

[22] Filed: Sep. 7, 1977

[30] Foreign Application Priority Data

Sep. 10, 1976 [DE] Fed. Rep. of Germany ..... 2640701

[51] Int. Cl.[2] ..... A42B 3/00

[52] U.S. Cl. ..... 2/10; 2/6

[58] Field of Search ..... 2/10, 6, 424; 403/328; 128/142.7, 142.4, 146.7

[56] References Cited

U.S. PATENT DOCUMENTS

| | | | |
|---|---|---|---|
| 3,035,573 | 5/1962 | Morton, Jr. et al. | 2/6 X |
| 3,513,841 | 5/1970 | Seeler | 128/146.7 |
| 3,910,269 | 10/1975 | Ansite et al. | 128/142.7 X |

*Primary Examiner*—Peter Nerbun

*Attorney, Agent, or Firm*—McGlew and Tuttle

[57] ABSTRACT

A head guard assembly comprises a protective head helmet, with a face protective breathing mask coupled to the helmet by interengagement of a coupling pin carried on each side of the face mask with a socket member carried on each side of the protective helmet. The socket member includes a bore which is tapered outwardly in a funnel-shape and is of oval configuration so as to conform close to the inside of the helmet side flaps. It has an interior widened portion in the bore forming catch grooves which are engaged by ball members which are carried in the recess of the coupling member and are biased by a spring into outward engagement with the catch groove when the coupling pin is inserted. The coupling pin includes an uncoupling member which moves against the balls to cause them to be pressed into the recess of the member to permit withdrawal of the mask from the helmet. The socket member is mounted on the helmet by means of a slide which may be slid in directions toward and away from the coupling pin and locked in an adjusted position in order to regulate the interfitting of the mask with the helmet.

6 Claims, 2 Drawing Figures

HEAD GUARD ASSEMBLY COMPRISING A PROTECTIVE HELMET AND A PROTECTIVE BREATHING MASK

FIELD AND BACKGROUND OF THE INVENTION

This invention relates in general to breathing devices and, in particular, to a new and useful head guard assembly, comprising a protective helmet and a protective breathing mask which are detachably connected to each other by interengaging retaining means.

DESCRIPTION OF THE PRIOR ART

The wearing of a protective helmet has become almost a matter of course at the present time. For many activities, it becomes more frequently necessary that a protective breathing mask be put on in addition. For such occasions, the protective helmet and the protective breathing mask are matched to each other in a manner such that the breathing mask can be put on rapidly, simply and securely, without the necessity of removing the helmet.

In a known device of this kind, the face zone of both the protective helmet and of the protective breathing mask is provided with retaining means which interengage to form a detachable connection with the protective helmet put on and the breathing mask attached thereto later. To this end, the helmet is equipped with a holding member engaging a recess which is provided in the rim of the mask. For individual adjustment, the holding member may be designed as a set screw. For further securing the fit, additional detachable connecting means may be provided which engage at the lower rim portion of the mask.

The mask may be donned without having to take off the protective helmet. The holding means connect the helmet and the mask to each other by bracing them against the user's forehead. In this way, a secure adjustment of the strapless mask to face along the sealing peripheral contact line is not obtained. The additional connecting means at the lower rim of the mask are of little value in this respect, see German Offenlegungsschrift No. 23 21 605.

Another known head guard device comprises a protective helmet which is combined with a protective breathing mask by means of a detachable connection. The connection is established by interengaging holding means. The holding means are stop seats in the form of lugs provided on the mask in approximately parallel arrangement to the rim, and spring-baised stop pins provided opposite thereto on the helmet rim. By turning grip sleeves in which the stop pins are received, the breathing mask is fitted to the face under a tolerable and adjustable contact pressure, see German Patent Appln. No. P 25 49 979.

SUMMARY OF THE INVENTION

The present invention is directed to a mask and helmet construction in which, with the protective helmet put on, the protective breathing mask can be connected thereto in a manner such that a secure protection and relaible sealing are obtained and, in addition, the strapless mask is adjusted to the shape of the user's head and face. With the inventive arrangement, it is also possible to attach the mask rapidly and without assistance from another party.

For this purpose, in accordance with the invention, a coupling socket is provided adjacent each side of the protective helmet which is secured thereto by means of a clamping slide and has an oval, funnel-shaped, catch opening and a catch groove, and a coupling pin is provided on each side of the protective breathing mask and equipped with unlockable snap balls.

The particular advantages obtained with the invention are that, with the protective helmet put on, the protective breathing mask can be attached and connected to the helmet and adjusted to the shape of the user's head and face rapidly and without outside help. This is an absolutely necessary prerequisite for a purposeful use of the protective helmet. Due to the large funnel-shape opening of the coupling socket, the coupling pins find their matching piece necessary for a secure connection. The simple locking through the snap balls advantageously operates automatically. After this engagement, the clamping slides must be shifted rearwardly from the face, to adjust and seal the breathing mask. Upon any motion, the slides instantly lock against the helmet wall at the location reached. This enables the user to find the best adjustment in a most simple manner.

In order to remove the protective breathing mask, slide pieces which are provided in the clamping slides for unlocking are pushed inwardly and then, for disengaging the coupling pins from the coupling sockets, unlocking members of the coupling pins on the mask are pushed in. In accordance with a development of the invention, in order to prevent any inconvenience or perhaps injury to the user in case of particular head or face shapes, the coupling socket may be made of a resilient material or, at the catch opening, of a foldable sheet metal.

In a further development of the invention, the clamping slides which are guided in a slot are locked in position by means of a roller which is pressed by a spring against an inclined surface and unlocked by means of a slide piece. With this design, one of the objectives of the invention, namely, to make possible a well-adjusted and sealing fit in the most simple manner, is satisfactorily achieve. Any adjustment and, thereby, clamping force, may be chosen. To unlock the mask, it is sufficient to push the slide pieces inwardly.

In order to make an adaptation even to particularly narrow heads and faces possible, the coupling sockets and clamping slides are resiliently connected to each other by a leaf spring, and the clamping slides are equipped with a set screw bearing against the coupling socket. In accordance with its adjustment, the set screw pushes the coupling socket away from the helmet wall in the direction of the interior of the helmet. This ensures that even with use of the equipment on a narrow head, for example, the coupling pins will securely fit into the catch openings of the coupling sockets.

The advantageously simple design of the unlocking mechanism of the coupling pins, having a necked-down portion for the snap balls and including a compression spring, is shown in FIG. 1. It is evident therefrom that the necessary cleaning and disinfection of the protective breathing mask will not affect the function of the locking and unlocking mechanisms.

Accordingly, it is an object of the invention to provide a head guard assembly which comprises a protective head helmet and a face protective breathing mask and coupling means carried on each respective side of the helmet and mask for detachably interengaging the helmet and the mask, wherein the coupling means includes a socket-forming member on one of the parts and a coupling pin on the other part which engages into a recess of the socket-forming member and includes an engagement member which moves outwardly into a catch groove of the socket-forming member and, wherein, the socket-forming member is mounted on its associated part for displacement toward and away from the coupling member so as to permit adjustment between the breathing mask and the helmet after the coupling is established.

A further object of the invention is to provide a combined face mask and helmet construction with the means for coupling these elements together and for adjustably fitting them together.

Another object of the invention is to provide a head guard assembly which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
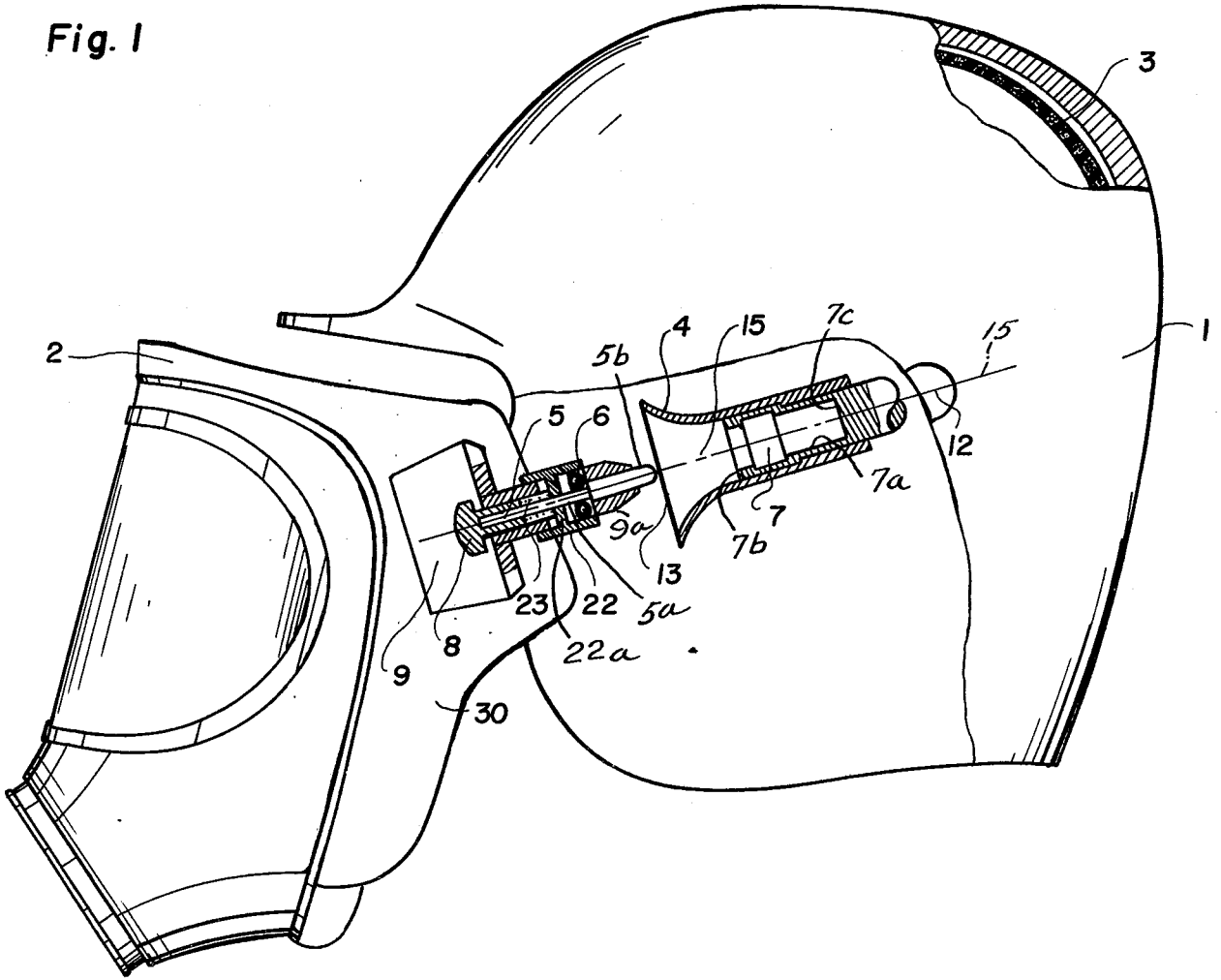
FIG. 1 is a side elevational view, partly in section, of a head guard assembly, constructed in accordance with the invention.

Referring to the drawings in particular, the invention embodied therein, comprises a head guard assembly which includes a head helmet 1, with a face protective breathing mask 2, which may be engaged over the head and face of the wearer and which may be coupled together by coupling means comprising a socket-forming member or coupling socket 4 carried by one of the parts and a coupling member in the form of a coupling pin 5 carried by the other of the parts. Advantageously, the coupling member 4 is mounted for adjustable movement on its associated helmet 1 by means of a clamping slide 11 which permits it to be moved toward and away from the coupling pin, as indicated by the double-arrow 30, shown in FIG. 2.

The head guard assembly comprises both the protective helmet 1 and the protective breathing mask 2. The mask 2 is strapless, but is otherwise designed in the usual manner. The protective helmet is equipped with a head lining 3 which is known per se. To connect the two parts of the head guard assembly, connecting mechanism are provided on either side, comprising the coupling socket 4 mounted on helmet 1, and the coupling pin 5 mounted on the mask 2. Upon introducing the coupling pins 5 into coupling sockets 4, snap balls 6, with which the pins are equipped, snap under the force of a biasing spring 23 into a catch groove 7 provided in coupling socket 4. The two parts of the guard assembly are thereby coupled to each other.

Coupling pin 5 includes a necked-down portion **5*a* and a head portion 5*b*. Coupling pin 5 is further connected on its side adjacent the mask 2 to an uncoupling member 8 which with the coupling 5 is slidable along the major axis 15 within a support extension 9*a* of a support 9. The snap balls or engagement members 6 are positioned adjacent the necked-down portion 5*a* within a suitably provided bore in the support extensions 9*a*. Snap balls 6 are retained in this position by an overlaying sleeve 22 which includes a platform portion 22*a* that is slidable along the axis 15 in a suitably provided slot in support extension 9*a*. The biasing or compression spring 23 is provided between the uncoupling member 8 and the platform portion 22*a* and biases the sleeve 22 over the snap balls 6. Upon insertion of the coupling pin 5 into the coupling socket 4, support extension 9*a* is seated within a reduced diameter bore 7*a* adjacent the catch groove 7. Sleeve 22 abuts against a shoulder 7*b* adjacent the groove 7, and is pushed backwardly against the bias of spring 23 to expose snap balls 6 to the groove 7. Simultaneously, head portion 5*b* of coupling pin 5 is pushed backwardly in the direction of support 9 when it is adjacent back wall 7*c* adjacent reduced diameter bore 7*a*. Head portion 5*b* is thereby disposed adjacent the snap balls 6 within the groove 7 biasing them radially outwardly toward the groove 7. The mask 2 is thereby engaged with the helmet 1 through the engagement of snap balls 6 within the groove 7. Head portion 5*b* is displaced towards the snap balls 6 through the action of biasing spring 23 on the uncoupling member 8**.

To effect uncoupling, the uncoupling member 8 is provided which, upon being pushed in against the action of the compression spring 23, enables snap balls 6 to move freely into the necked-down portion or recess **5*a*, so that they can move aside in the direction of the axis 15 of coupling pin 5**.

Figure 2:
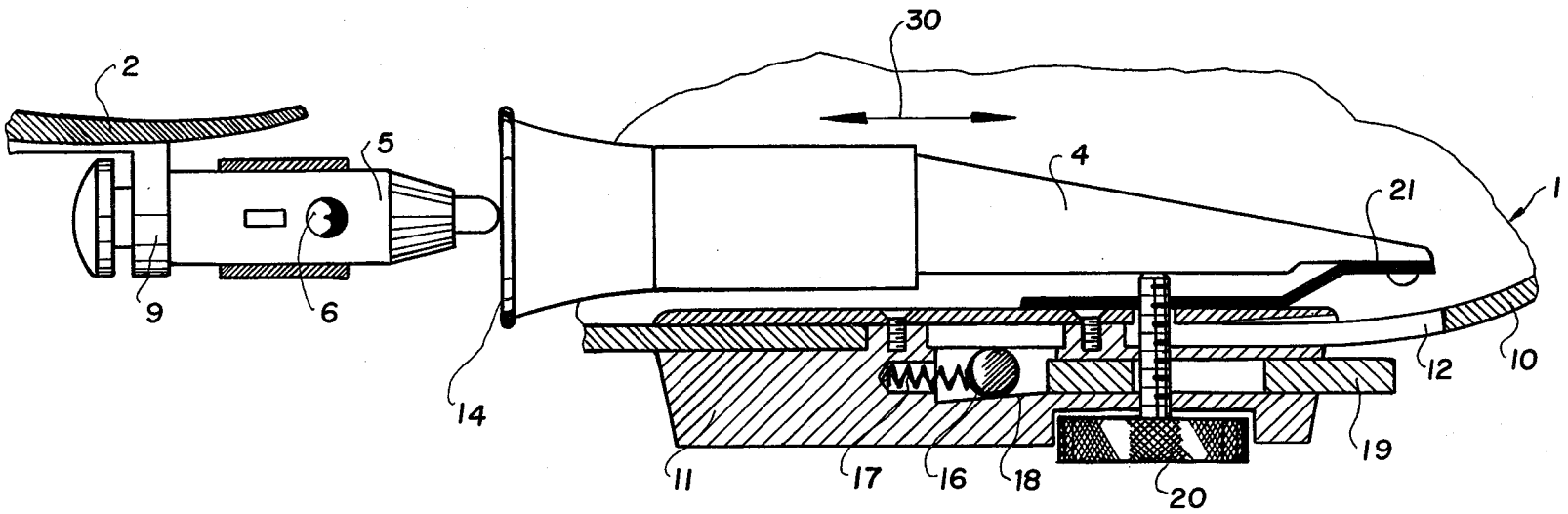
FIG. 2 is an enlarged partial sectional view of the coupling elements shown in FIG. 1.

Coupling pins 5 are secured to each side of the breathing mask 2 by means of supports 9 in the form of angle pieces secured on side flap areas 30 of the face mask 2. As shown in FIG. 2, the coupling sockets 4 are mounted for axial displacement at the inside of outer wall 10 of protective helmet 1. They are secured to clamping slides 11 which are guided for displacement in slots 12 of helmet wall 10. Coupling socket 4 has an oval, funnel-shaped opening 13.

A major axis 15 of the opening 13 extends parallel to the lateral helmet wall 10 and the minor axis 14 is perpendicular thereto. With this design, a large area of the catch opening 15 is obtained while, at the same time, the funnel-shaped portion produces no disturbing effect in the interior of helmet 1. Coupling socket 4 is made of a resilient material, in order to obtain a still further, non-disturbing, adjustment conforming to the shape of the user's head.

While putting on the protective breathing mask 2, the large catch opening 13 ensures that coupling pins 5 can be introduced into coupling sockets 4 and, consequently, helmet 1 can be connected to mask 2 without a particular observation of the relative position. A sealing adjustment of the rim of the breathing mask to the user's face is obtained by pulling coupling socket 4 axially into the interior of helmet 1. For this purpose, clamping slides 11, to which coupling sockets 4 are secured by means of leaf springs 21, are slidably displaceable in slots 12 and lockable in the desired position. The locking is effected by means of a roller 16 which is pressed, by a spring 17 and an inclined surface 18, against wall 10 of the protective helmet. A slide piece 19 is pushed inwardly to unlock slide 11 and, thereby, socket 4.

To further adjust the mechanism to the shape of the head of the user, a secure displacement of coupling socket 4 in the direction of the user's head is provided, by means of a set screw 20 which is rotatably threaded into spring 21 and bears against the socket 4.

While a specific embodiment of the invention has been shown and described in detail to illustrate the application of the principles of the invention, it will be understood that the invention may be embodied otherwise without departing from such principles.

What is claimed is:

1. A head guard assembly, comprising a protective head helmet, a face protective breathing mask, and coupling means carried on each respective side of said helmet and said mask for detachably interengaging said helmet and said mask and including a socket-forming member on one of said helmet and mask and a coupling pin on the other of said helmet and mask, said socket-forming member having an oval outwardly tapered receiving socket bore with an internal widened portion defining a catch groove therein, said coupling pin having a necked-down portion, at least one engagement member in said necked-down portion movable radially outwardly into engagement with said catch groove, spring means biasing said engagement member outwardly but permitting inward movement thereof, and means mounting said socket-forming member for displacement on its associated helmet and face mask in directions toward and away from said coupling pin to adjust said breathing mask relative to said helmet, wherein said means mounting said socket-forming member comprises a slide movable on said helmet, a set screw threadedly engaged in said slide and bearing against said socket-forming member to adjust said socket-forming member relative to said slide and to the interior of said helmet.

2. A head guard assembly, comprising a protective head helmet, a face protective breathing mask, and coupling means carried on each respective side of said helmet and said mask for detachably interengaging said helmet and said mask and including a socket-forming member on one of said helmet and mask and a coupling pin on the other of said helmet and mask, said socket-forming member having an oval outwardly tapered receiving socket bore with an internal widened portion defining a catch groove therein, said coupling pin having a necked-down portion, at least one engagement member in said necked-down portion movable radially outwardly into engagement with said catch groove, spring means biasing said engagement member outwardly but permitting inward movement thereof, and means mounting said socket-forming member for displacement on its associated helmet and face mask in directions toward and away from said coupling pin to adjust said breathing mask relative to said helmet, said mounting means including a slide member slidable on said helmet and means for locking said slide in an adjusted position after movement of said slide in a direction away from said coupling pin, said slide including a recess therein, a ball in said recess, means urging said ball in a direction away from said coupling pin, the wall bounding one side of said recess being tapered to a widened portion in a direction toward said coupling pin and a wall surface defined by said helmet adjacent said slide engageable with said ball and locking said ball against said portion of said helmet together with said slide and said socket-forming member in an adjusted position.

3. A head guard assembly, according to claim 2, wherein said socket-forming member is made of a resilient material.

4. A head guard assembly, according to claim 2, including a leaf spring connected between said slide and said socket-forming member.

5. A head guard assembly, comprising a protective head helmet, a face protective breathing mask, and coupling means carried on each respective side of said helmet and said mask for detachably interengaging said helmet and said mask and including a socket-forming member on one of said helmet and mask and a coupling pin on the other of said helmet and mask, said socket-forming member having an oval outwardly tapered receiving socket bore with an internal widened portion defining a catch groove therein, said coupling pin having a necked-down portion, at least one engagement member in said necked-down portion movable radially outwardly into engagement with said catch groove, a sleeve slidable along said coupling pin to engage over said engagement member and retain it in said necked-down portion, biasing means between said sleeve and said coupling pin to urge said sleeve over said engagement member, said coupling member including a head portion of a diameter greater than said necked-down portion displaceable toward said engagement member when said coupling pin is positioned within said socket-forming member and said sleeve being displaceable against the bias of said biasing means and away from said engagement member when said coupling pin is engaged within said socket forming member so that said head portion of said coupling pin urges said engagement member radially outwardly into engagement with said catch groove through the action of said biasing means whereby said coupling pin may be displaced against the bias of said biasing means to position said necked-down portion adjacent said engagement member to permit the radially inwardly displacement of said engagement member out of engagement with said catch groove and the withdrawal of said coupling pin from said socket-forming member.

6. A head guard assembly, according to claim 5, wherein said mounting means for said socket-forming member includes a slide movable backwardly and forwardly on each side of said helmet, said face mask having an angle member on each side, said coupling pin being mounted on respective angle members.

* * * * *